US006262379B1

(12) United States Patent
Tajima

(10) Patent No.: US 6,262,379 B1
(45) Date of Patent: Jul. 17, 2001

(54) SWITCH APPARATUS

(75) Inventor: Yuji Tajima, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 09/658,875

(22) Filed: Sep. 8, 2000

(30) Foreign Application Priority Data

Sep. 16, 1999 (JP) ..... 11-261889

(51) Int. Cl.[7] ..... H01H 9/00
(52) U.S. Cl. ..... 200/5 R; 200/18
(58) Field of Search ..... 200/5 R, 16 R, 200/16 A, 16 C, 17 R, 18, 547, 551, 329, 6 R, 6 B, 6 BA

(56) References Cited

U.S. PATENT DOCUMENTS 5,243,156 9/1993 Shirasaka ..... 200/5 R
5,384,440 1/1995 Wnuk et al. ..... 200/5 R
5,442,149 8/1995 Sato ..... 200/5 R
5,844,182 12/1998 Hirano et al. ..... 200/5 R
5,866,862 2/1999 Riffil et al. ..... 200/5 R

*Primary Examiner*—Michael Friedhofer
(74) *Attorney, Agent, or Firm*—Morgan, Lewis & Bockius LLP

(57) ABSTRACT

A cover (32) is provided with a first and a second guide holes (32*a*, 32*b*) and an intermediate projection (33). A first and a second projections (34*a*, 35*a*) of a first and a second movable members (34, 35) are inserted into the first and the second guide holes (32*a*, 32*b*). On a back face of an operating knob (36) is provided a first guide part (37) into which the intermediate projection (33) is adapted to be inserted, a second and a third guide parts (38, 39) into which the first and the second projections (34*a*, 35*a*) are adapted to be inserted. When the first movable member (34) is moved in a direction of an arrow (A1) by an operation of the operating knob (36), a reclining switch (13) is actuated, and when the second movable member (35) is moved in a direction of an arrow (A2), a head restraint switch (14) is actuated.

1 Claim, 4 Drawing Sheets

SWITCH APPARATUS

BACKGROUND OF THE INVENTION

1. Technical Field

The present invention relates a switch assembly structure in which a first switch element and a second switch element are adapted to be selectively operated by a single operating knob.

2. Related Art

FIG. 3 shows a schematic plan view of a power seat switch in a vehicle. This power seat switch is composed of a first switch device 1 on the right side and a second switch device 2 on the left side. A cover 4 corresponding to the first switch device 1 and a cover 5 corresponding to the second switch device 2 are mounted on a common switch body 3.

The first switch device 1 is so constructed as to operate a reclining switch for adjusting a reclined angle of a back of a seat and a head restraint switch for adjusting a height of a head restraint provided on a top of the seat back. In the cover 4 of the first switch device 1 is formed a guide hole 4*a* in a shape of a cross and a cut-out 4*b* so as to be adjacent to each other as shown in FIG. 4. A projection 3*a* provided on a switch body 3 is inserted into the cut-out 4*b* and projects upward from the cover 4.

A plate 6 is fixed to the switch body 3 underneath the cover 4. The plate 6 is provided with a guide hole 6*a* in a shape of a cross, and an elongated guide hole 6*b* so as to be adjacent to each other. A knob holder 7 is slidably mounted on the plate 6. The knob holder 7 has a projection 7*a* which is adapted to be inserted into the guide hole 4*a* on its upper face, and two projections 7*b* and 7*c* which are adapted to be inserted into the guide holes 6*a* and 6*b* respectively on its lower face. Two holders 8, 9 are disposed underneath the plate 6 at positions below the guide holes 6*a* and 6*b*, respectively. Into recesses 8*a* and 9*a* formed in the holders 8 and 9 respectively, the corresponding projections 7*b* and 7*c* are adapted to be inserted. The recess 8*a* of the holder 8 into which one of the projections 7*b* is inserted extends in a direction of an arrow A1, while the recess 9*a* of the holder 9 into which the other projection 7*c* is inserted extends in a direction of an arrow A2 which intersects the direction A1.

A coil spring 10, a bifurcated member 11, and a pair of contact blades 12 are disposed below each of the holders 8, 9. The switch body 3 is provided with fixed contacts (not shown) corresponding to the contact blades 12 respectively. A pair of the contact blades 12 corresponding to the holder 9 and the mating fixed contacts constitutes the reclining switch 13 as a switch element, while a pair of the contact blades 12 corresponding to the holder 8 and the mating fixed contacts will constitute the head restraint switch 14 as a switch element.

A single operating knob 15 is fitted to the above described projection 3*a* and the projection 7*a* of the knob holder 7. A guide part 16 consisting of a pair of ribs 16*a*, and an engaging tubular part 17 are provided on a back face of the operating knob 15. The projection 3*a* is inserted into the guide part 16, and the projection 7*a* is inserted into the engaging tubular part 17.

In the above described structure, when the knob holder 7 is operated to move in the direction of the arrow A1 in FIG. 3 by operating the operating knob 15, the holder 9 moves in the same direction, and the reclining switch 13 is actuated with this movement. On this occasion, since the holder 8 will not be moved, the head restraint switch 14 will not be actuated.

When the knob holder 7 is operated to move in the direction of the arrow A2 in FIG. 3 by operating the operating knob 15, the holder 8 moves in the same direction, and the head restraint switch 14 is actuated with this movement. On this occasion, since the holder 9 will not be moved, the reclining switch 13 will not be actuated.

On the other hand, the second switch device 2 on the left side has a front vertical switch 18 for adjusting a front part of the seat in a vertical direction, a slide switch 19 for adjusting back and forth positions of the seat, and a rear vertical switch 20 for adjusting a rear part of the seat in a vertical direction. These three switches 18 19, and 20 are adapted to be operated by a single operating knob 21. These three switches 18, 19 and 20 are of a same fundamental structure. As shown in FIG. 5, each of the switches 18, 19 and 20 is composed of a movable member 22 provided with a projection 22*a*, and a coil spring 10, a bifurcated member 11, a pair of contact blades 12 and fixed contacts (not shown) on the switch body 3 which are similar to those elements provided in the switches 13, 14.

The aforesaid cover 5 is provided with three guide holes 5*a*, 5*b* and 5*c* into which the projections 22*a* of the movable members 22 are inserted respectively. In these three guide holes 5*a* to 5*c*, the center guide hole 5*b* extends in a direction of an arrow B1 in FIG. 3. The projection 22*a* of the corresponding movable member 22 is inserted into the guide hole 5*b*. The left and right guide holes 5*a* and 5*c* extend in a direction of an arrow B2 in FIG. 3, and the projections 22*a* of the corresponding movable members 22 are respectively inserted into the guide holes 5*a* and 5*c*.

In the above described structure, when the operating knob 21 of the second switch device 2 is operated in the direction of the arrow B1, the movable member 22 in the center part moves in the same direction, and the slide switch 19 is actuated with this movement. On this occasion, the left and the right movable members 22 do not move, and both the front and the rear vertical switches 18, 20 are not actuated.

When a left part of the operating knob 21 in FIG. 3 is operated in the direction of the arrow B2, the left side movable member 22 moves in the same direction, and the front vertical switch 18 is actuated. On this occasion, the center and the right hand movable members 22 in FIG. 3 do not move, and both the slide switch 19 and the rear vertical switch 20 is not actuated.

When a right part of the operating knob 21 in FIG. 3 is operated in the direction of the arrow B2, the right side movable member 22 moves in the same direction, and the rear vertical switch 20 is actuated. On this occasion, the center and the left hand movable members 22 in FIG. 3 do not move, and both the slide switch 19 and the front vertical switch 18 are not actuated.

When the entire operating knob 21 is operated in the direction of the arrow B2 in FIG. 3, both the left hand and the right hand movable members 22 synchronously move in the same direction, and both the front and the rear vertical switches 18, 20 are actuated. On this occasion, the center movable member 22 does not move, and the slide switch 19 is not actuated.

In this case, the above described first switch device is so constructed that the single operating knob 15 can selectively actuate either of the reclining switch 13 and the head restraint switch 14. On this occasion, these two switches 13 and 14 are prevented from being simultaneously actuated by the two projections 7*b*, 7*c* provided on the lower face of the knob holder 7 and the two guide holes 6*a*, 6*c* of the plate 6.

However, a cost for the switch assembly of this structure is high, because it requires a number of components such as the knob holder 7, the plate 6 and the two holders 8, 9 in addition to the operating knob 15 and the cover 4, and a number of assembling steps accordingly. Moreover, the knob holder 7, the plate 6 and the holders 8, 9 cannot be used commonly as the components for the second switch device 2, and must be manufactured for exclusive use. It is a further drawback that a large space is required in a direction of a depth.

SUMMARY OF THE INVENTION

The present invention has been made in view of the above described circumstances. The object is to provide a switch assembly of a structure in which two switch elements can be selectively actuated by operating a single operating knob, and the number of the components can be decreased, and the space in a direction of the depth can be minimized.

In order to achieve the above described object, there is provided, according to the invention, a switch assembly which comprises;

a switch body, a cover mounted on the switch body, and including a first guide hole extending in a first direction and a second guide hole extending in a second direction intersecting the first direction, an intermediate projection provided between the first guide hole and the second guide hole projecting in a direction opposite to the switch body, a first movable member disposed between the switch body and the cover, and including a first projection adapted to be inserted into the first guide hole, the first movable member being movable along the first guide hole by way of the first projection, a second movable member disposed between the switch body and the cover, and including a second projection adapted to be inserted into the second guide hole, the second movable member being movable along the second guide hole by way of the second projection, a first switch element adapted to be actuated based on a movement of the first movable member, a second switch element adapted to be actuated based on a movement of the second movable member, an operating knob placed on the intermediate projection, and the first and second projections, a first guide part provided on the operating knob so as to receive the intermediate projection and adapted to guide movements of the operating knob in the first and second directions, a second guide part provided on the operating knob so as to receive the first projection and adapted to move the first movable member along the first guide hole in the first direction by way of the first projection when the operating knob is operated in the first direction, and adapted to guide the movement of the operating knob in the second direction with respect to the first projection when the operating knob is operated to move in the second direction, and a third guide part provided on the operating knob so as to receive the second projection and adapted to move the second movable member along the second guide hole in the first direction by way of the second projection when the operating knob is operated in the second direction, and adapted to guide the movement of the operating knob in the first direction with respect to the second projection when the operating knob is operated to move in the first direction.

In the above described structure, when the second guide part of the operating knob is operated in the first direction, the first movable member is moved in the first direction along the first guide hole by way of the first projection by means of the second guide part, and the first switch element is actuated accordingly. When the third guide part of the operating knob is operated in the second direction, the second movable member is moved in the second direction along the second guide hole by way of the second projection by means of the third guide part, and the second switch element is actuated accordingly.

In this case, the two switch elements is prevented from being synchronously operated by means of the first guide part of the operating knob. Although this structure requires the first and the second movable members as the movable members to be operated by the operating knob, the exclusive knob holders, the plate, and the two holders which have been required in the conventional structure are not necessary, thus enabling the number of the components to be reduced. Moreover, because the number of the components is reduced in the direction of the depth, the space in the direction of the depth can be minimized.

DETAILED DESCRIPTION OF PREFERRED EMBODIMENT

Figure 1:
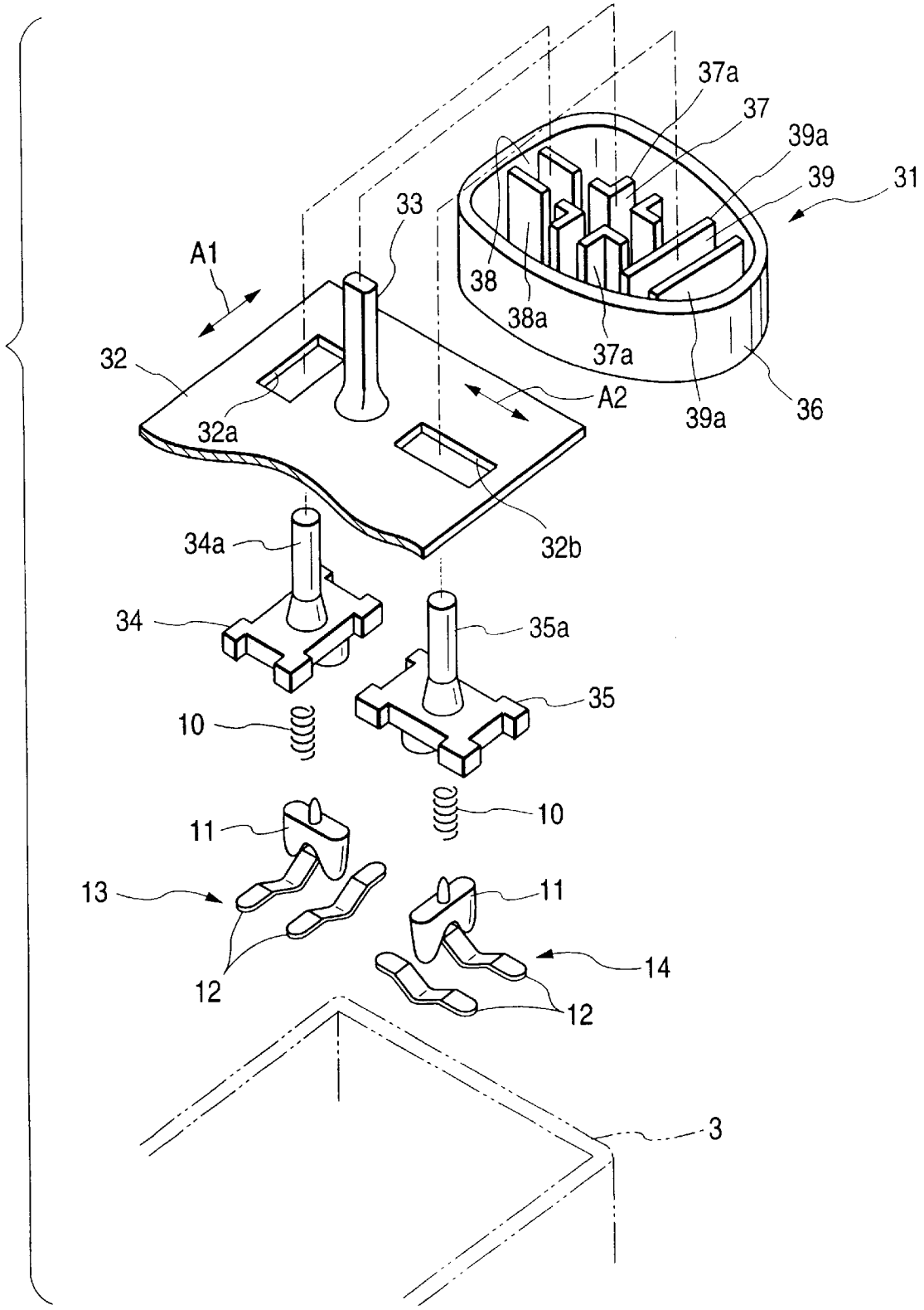
FIG. 1 is an exploded perspective view showing an embodiment according to the invention.
Figure 2:
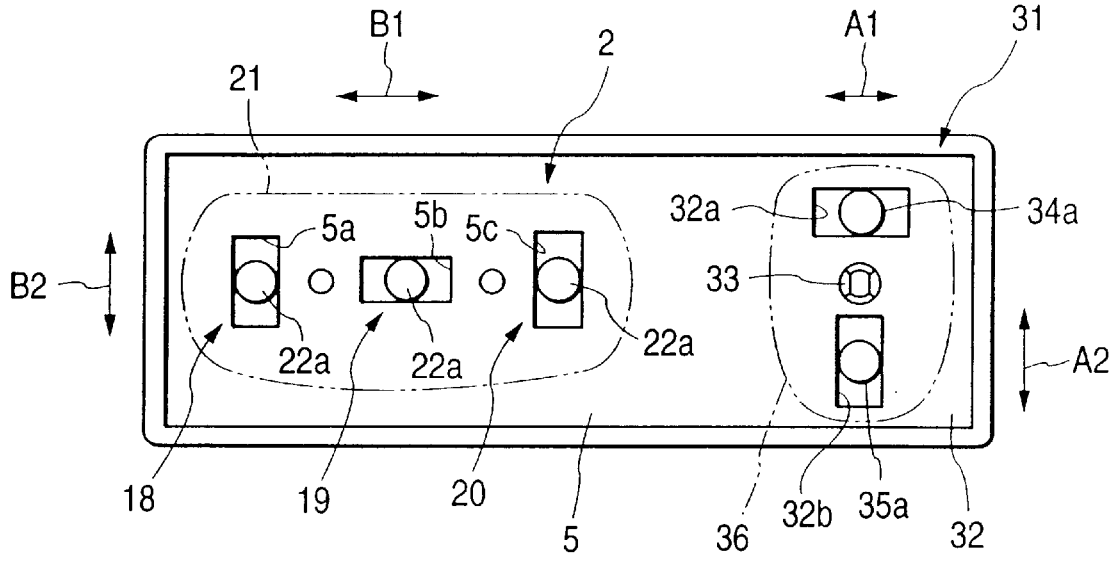
FIG. 2 is a plan view of a power seat switch assembly.
Figure 3:
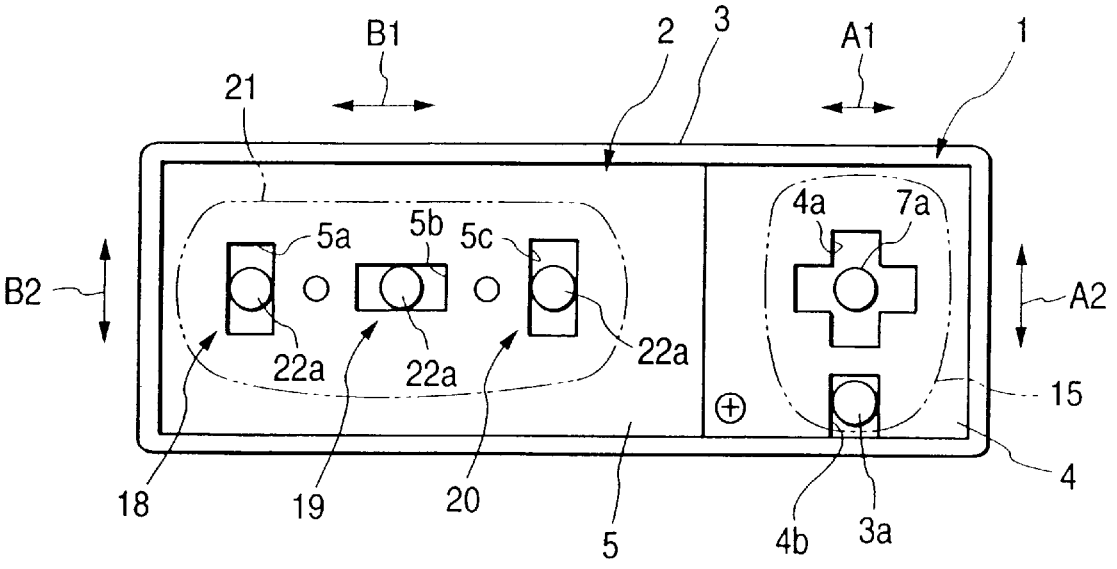
PRIOR ART FIG. 3
FIG. 3 is a view corresponding to FIG. 2 showing a conventional structure.
Figure 4:
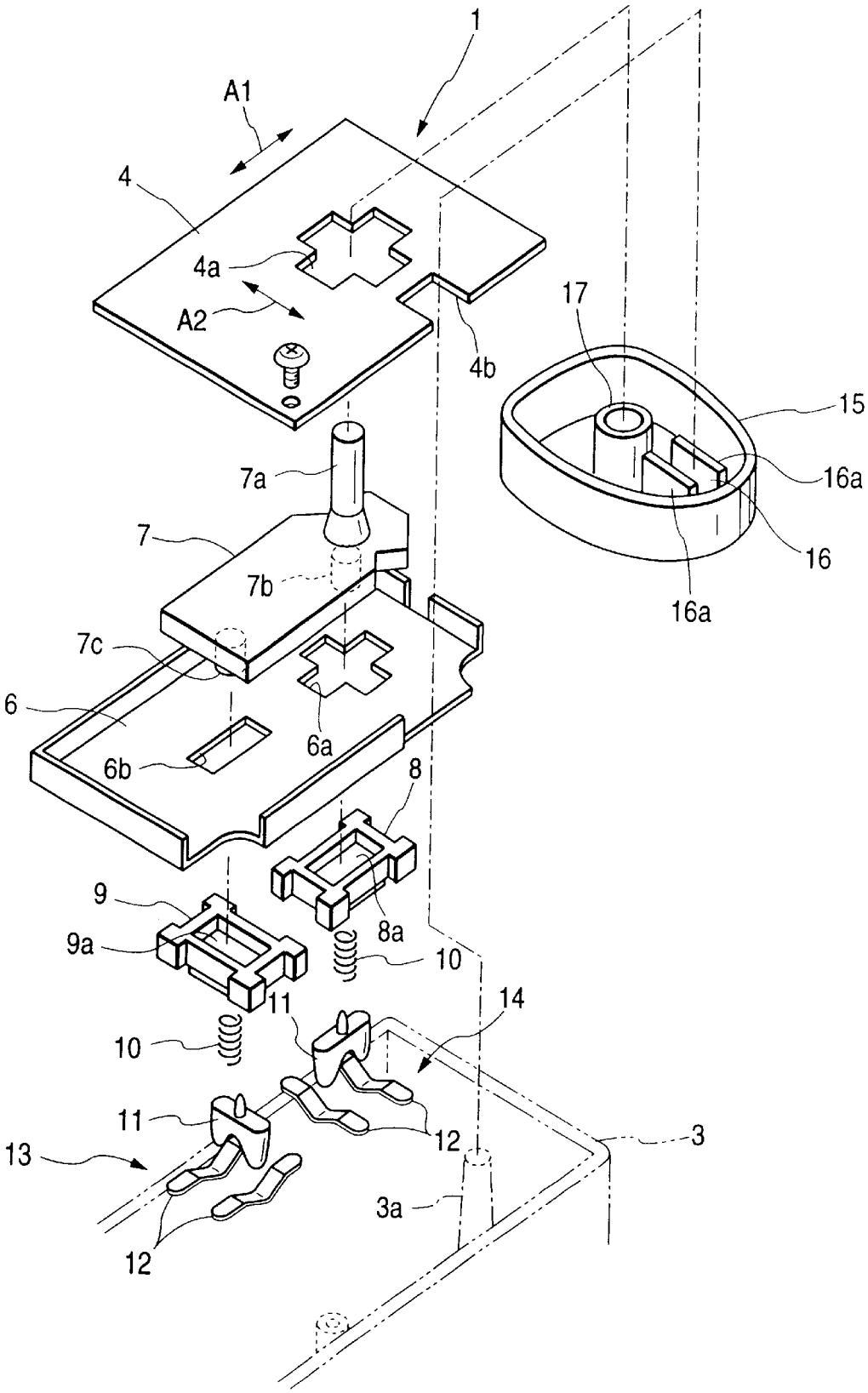
FIG. 4 is a view corresponding to FIG. 1 showing a conventional structure.
Figure 5:
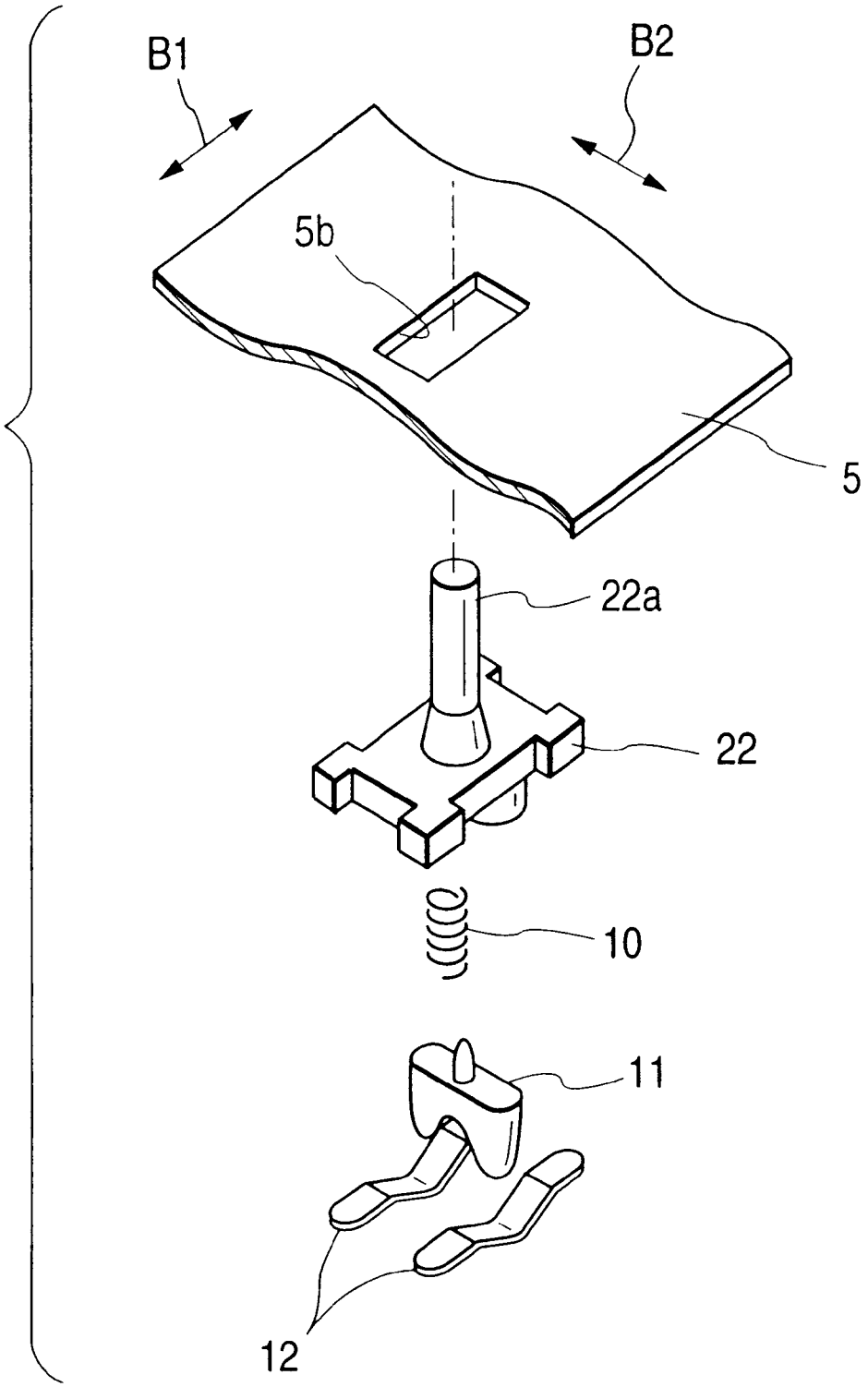
FIG. 5 is an exploded perspective view of a part of a second switch device.

Now, referring to FIGS. 1 and 2, the invention will be described by way of an embodiment in which the invention is applied to a power seat switch assembly in a vehicle. In the description, those parts which are same as in the conventional case will be denoted with the same reference numerals to omit their explanation, and different parts only will be described.

In a first switch device 31, a cover 32 is integrally formed with the cover 5 of the second switch device 2. The cover 32 is provided with a first guide hole 32*a* which extends in the direction of the arrow A1 in this case, and a second guide hole 32*b* which extends in the direction of the arrow A2 in this case. An intermediate projection 33 is provided on an upper face of the cover 32 between the first guide hole 32*a* and the second guide hole 32*b* projecting upward (in a direction opposite to the switch body 3).

Below the cover 32, there are provided a first movable member 34 having a first projection 34*a* adapted to be inserted into the first guide hole 32*a*, and a second movable member 35 having a second projection 35*a* adapted to be inserted into the second guide hole 32*b*. Coil springs 10, bifurcated members 11, and pairs of contact blades 12 are provided at positions corresponding to these first and second movable members 34 and 35. In this case, the first and the second movable members 34 and 35 are of the same structure as the movable members 22 which are employed in the second switch device 2.

The switch body 3 is provided with fixed contacts (not shown) corresponding to the contact blades 12 respectively.

A pair of the contact blades 12 corresponding to the first movable member 34 and the mating fixed contacts constitute the reclining switch 13 as the first switch element. A pair of the contact blades 12 corresponding to the movable member 35 and the mating fixed contacts constitute the head restraint switch 14 as the second switch element.

A single operating knob 36 is mounted on the intermediate projection 33, and the first and the second projections 34*a* and 35*a*. As shown in FIG. 1, a first guide part 37 substantially in a shape of a cross composed of four L-shaped ribs 37*a* substantially at a center part, a second guide part 38 composed of a pair of ribs 38*a* extending in the direction of the arrow A2 (the second direction) at a position corresponding to the first projection 34*a*, and a third guide part 39 composed of a pair of ribs 39*a* extending in the direction of the arrow A1 (the first direction) at a position corresponding to the second projection 35*a* are provided on a back face of the operating knob 36. The intermediate projection 33 is inserted into the first guide part 37 so as to be movable relatively in the direction of the arrow A1 and in the direction of the arrow A2. The first projection 34*a* is inserted into the second guide part 38 so as to be movable relatively in the direction of the arrow A2. The second projection 35*a* is inserted into the third guide part 39 so as to be movable relatively in the direction of the arrow A1.

The second switch device 2 is of the same structure as the conventional case, and the explanation is omitted.

In the above described structure, when the operating knob 36 in the first switch device 31 is operated in the direction of the arrow A1, the first movable member 34 is moved by means of the rib 38*a* of the second guide part 38 along the first guide hole 32a in the direction of the arrow A1 through the first projection 34*a*. Accordingly, the reclining switch 13 is actuated. On this occasion, the second movable member 35 does not move, and the head restraint switch 14 is not actuated.

On the other hand, when the operating knob 36 is operated in the direction of the arrow A2, the second movable member 35 is moved by means of the rib 39*a* of the third guide part 39 along the second guide hole 32*b* in the direction of the arrow A2 through the second projection 35*a*. Accordingly, the head restraint switch 14 is actuated. On this occasion, the first movable member 34 does not move, and the reclining switch 13 is not actuated.

In the above described structure, the first movable member 34 and the second movable member 35 are prevented from being operated to move in their operative directions at the same time by means of the intermediate projection 33 and the first guide part 37 of the operating knob 36. Therefore, a simultaneously actuation of the reclining switch 13 and the head restraint switch 14 is prevented.

According to the above described embodiment, although the first movable member 34 and the second movable member 35 are necessary as the movable members to be operated by the operating knob 36, the exclusive knob holder 7. However, the plate 6 and the two holders 8, 9 which have been required in the conventional case are not necessary. Therefore, the number of the components can be reduced and accordingly, the number of the assembling steps is reduced resulting in a decrease of the cost. Moreover, because the movable members 22 which are employed in the second switch device 2 can be employed as the first movable member 34 and the second movable member 35 in this embodiment, a common use of the components is possible to reduce the cost more. Further, because the number of the components in the direction of the depth is decreased, the space in the direction of the depth can be minimized.

As apparent from the foregoing description, the switch assembly according to the invention is so constructed that the two switch elements can be selectively actuated by the single operating knob, the number of the components can be reduced, and the number of the assembling steps are reduced resulting in a decrease of the cost. Further, because the number of the components in the direction of the depth is decreased, the space in the direction of the depth can be minimized.

What is claimed is:

1. A switch apparatus comprising:

a switch body;

a cover mounted on said switch body, and including a first guide hole extending in a first direction and a second guide hole extending in a second direction intersecting said first direction;

an intermediate projection provided between said first guide hole and said second guide hole and projecting in a direction opposite to said switch body;

a first movable member disposed between said switch body and said cover, and including a first projection inserted into said first guide hole, said first movable member being movable along said first guide hole through said first projection;

a second movable member disposed between said switch body and said cover, and including a second projection inserted into said second guide hole, said second movable member being movable along said second guide hole through said second projection;

a first switch element is actuated based on a movement of said first movable member;

a second switch element is actuated based on a movement of said second movable member;

an operating knob covered on said intermediate projection, and said first and second projections;

a first guide part provided on said operating knob to receive said intermediate projection and guide movements of said operating knob in said first and second directions;

a second guide part provided on said operating knob to receive said first projection and move said first movable member along said first guide hole in said first direction through said first projection when said operating knob is operated in said first direction, and guide the movement of said operating knob in said second direction with respect to said first projection when said operation knob is operated to move in said second direction; and a third guide part provided on said operating knob to receive said second projection and move said second movable member along said second guide hole in said second direction through said second projection when said operating knob is operated in said second direction, and guide the movement of said operating knob in said first direction with respect to said second projection when said operating knob is operated to move in said first direction.

* * * * *